US006206222B1

(12) United States Patent
Cudzik

(10) Patent No.: US 6,206,222 B1
(45) Date of Patent: Mar. 27, 2001

(54) RESEALABLE CLOSURE ON SEAMED CAN END

(75) Inventor: Daniel F. Cudzik, Richmond, VA (US)

(73) Assignee: Ball Corporation, Broomfield, CO (US)

( * ) Notice: Subject to any disclaimer, the term of this patent is extended or adjusted under 35 U.S.C. 154(b) by 0 days.

(21) Appl. No.: 09/486,484

(22) PCT Filed: Aug. 28, 1998

(86) PCT No.: PCT/US98/17843

§ 371 Date: May 15, 2000

§ 102(e) Date: May 15, 2000

(87) PCT Pub. No.: WO99/10242

PCT Pub. Date: Mar. 4, 1999

Related U.S. Application Data

(60) Provisional application No. 60/057,387, filed on Aug. 28, 1997.

(51) Int. Cl.[7] ..... B65D 17/44

(52) U.S. Cl. ..... 220/258; 220/278; 220/906; 222/541.8; 222/83.5; 413/15; 413/22; 413/23

(58) Field of Search ..... 220/254, 255, 220/258, 267, 274, 277, 278, 906; 222/541.2, 541.8, 83, 83.5, 85, 88; 413/4, 12, 13, 15, 17, 22, 23, 24, 53

(56) References Cited

U.S. PATENT DOCUMENTS

| | | |
|---|---|---|
| 3,339,812 | 9/1967 | Meissner . |
| 4,911,323 | 3/1990 | Arfert et al. . |
| 5,292,025 | 3/1994 | Dubreul . |
| 5,348,182 | 9/1994 | Luch et al. . |

FOREIGN PATENT DOCUMENTS

| | | |
|---|---|---|
| 1442319 | 9/1966 | (FR) . |
| 531817 | 8/1955 | (IT) . |

*Primary Examiner*—Nathan J. Newhouse
(74) *Attorney, Agent, or Firm*—Sheridan Ross P.C.

(57) ABSTRACT

An easy-open, reseable closure assembly for a beverage can (10) comprises a metal lid (12) and two threadedly connected molded plastic closure elements (40, 60) with engageable annular reseal surfaces (46, 76). The lid is scored (30) to define a circular tear panel (28) and a hinge (32). The spout element (40) is attached to the lid (12) with the bottom surface of the cap element (60) directly above and aligned with the periphery of the tear panel (28). Rotation of the cap element (60) by a user ruptures the tear panel and pivots the tear panel (28) downward about the hinge (32), providing a passage through the spout element (40) for pouring and driking. Initial rupture and rupture propagation of the tear panel (28) is controlled by the spacing of the cap element (60) from the tear panel (28) and their configurations. When the cap element (60) is replaced on the spout (40), reseal surfaces (46, 76) engage.

20 Claims, 5 Drawing Sheets

C = CONVENTIONAL

C' = ESSENTIALLY CONVENTIONAL, WITH TOOLING AND/OR OTHER MINOR EQUIPMENT MODIFICATIONS.

RESEALABLE CLOSURE ON SEAMED CAN END

This application is a 371 of PCT/US 981/17843 filed Aug. 28, 1998 which claims benefits of Ser. No. 60/057,387 filed Aug. 28, 1997.

TECHNICAL FIELD

This invention pertains to the field of easy-open devices for beverage cans. These devices, when actuated by the consumer, provide an opening through the can end or lid for pouring and drinking.

BACKGROUND ART

Approximately 100 billion thin-walled metal beverage cans are sold annually in the United States alone. Nearly all of these beverage cans have a stay-on-tab type closure according to my U.S. Pat. Nos. 3,967,752 and 3,967,753, which issued on Jul. 6, 1976. These closures are part of a can end or lid which is double seamed to the can body in a conventional manner with conventional equipment in a beverage filling line.

The stay-on-tab end has a number of attributes which have enabled it to remain the industry standard for over 20 years. These attributes include (a) the ability to be manufactured by commercially available machines; (b) low material and manufacturing costs; (c) low rates of defective ends produced by the end manufacturing lines; (d) nestability for ease and economy in handling the shells (blanks) and ends in the manufacturing lines, shipping them, and handling them in the beverage filling lines; (e) ease and speed of filling the can with the beverage and then seaming the end onto the can, again at low cost; (f) reliable containment and protection of the beverage during shipping, distribution, display, and handling and use by the consumer, with respect to carbonated as well as non-carbonated contents; (g) ease of opening by consumers of widely varying finger sizes, strengths, and dexterity; (h) consumer safety; (i) reliability of opening by consumers; (j) pourability; (k) drinkability; and (l) recyclability, in terms of both the value of its constituent material and the cost of recovering it.

The attribute most lacking in stay-on-tab ends is resealability.

Numerous attempts have been made to provide resealable threaded closures for beverage cans. Some of these merely sought to replicate, in the metal can and end, the structure of the neck and closure of a bottle neck and cap. Others employed more ingenious, and sometimes complex, solutions. Examples of such solutions and concepts used for other containers may be found in Henderson U.S. Pat. No. 2,771,218, Meissner U.S. Pat. No. 3,339,812, Salamone U.S. Pat. No. 3,401,819, Dubreul U.S. Pat. No. 5,292,025, and French patent 1,048,219.

Such solutions, including the simple as well as the complex, have not been commercially successful for at least two reasons. First, they have failed to match one or more of the attributes of the stay-on-tab closures listed above. Low cost is probably the criterion which is most frequently not satisfied. It is safe to say that if cost were no object, all of the remaining criteria could be satisfied. Second, these solutions have failed to equal or surpass conventional PET bottles and caps, which, though not possessing all the attributes of a can with a stay-on-tab closure, possess many of them and nevertheless have resulted in an excellent package for beverages.

DISCLOSURE OF THE INVENTION

The object of the present invention is to provide an easy-open closure for thin-walled metal beverage cans which has the attribute of resealability, as well as attributes of stay-on-tab ends to a degree which is consistent with the commercial needs of the beverage industry.

The present invention provides an assembly for closing and sealing a thin-walled metal can containing a beverage. The assembly may be quickly and easily opened by the consumer, provides a spout for pouring and drinking the beverage, and is conveniently resealable by the consumer. The assembly consists of three parts—a metal end and two threaded closure elements.

The end, which has been cut and formed from sheet metal, has a weakened line, for example a score line. The weakened line defines a hinge and a tear panel which can be pivoted downward about the hinge.

One threaded element is a stationary spout element which is attached to the end so as to surround the tear panel. The other threaded element is a rotatable cap element which has a bottom bearing surface immediately above and aligned with the periphery of the tear panel. Sealing surfaces on the respective closure elements face each other and are designed to engage each other for resealing, but are spaced apart initially.

When the consumer rotates the cap element clockwise, it is driven downward by the threads so that its bottom bearing surface ruptures the weakened line at a location distant from the hinge. Continued rotation causes the rupture to propagate along and around the weakened line in two directions toward the hinge. As this is occurring the cap element's bottom bearing surface is also forcing the tear panel to pivot downward about the hinge, until eventually the tear panel has been swung down and out of the way of the opening it has left.

The consumer rotates the cap element in the counterclockwise direction to remove it from the spout element in the usual manner, and pours or drinks the beverage through the opening in the end and the spout. The consumer may reseal the closure by replacing it on the spout element and rotating it clockwise in the usual manner, past the position which pivoted the tear panel down, until the reseal surfaces engage and form a pressure seal.

Preferably the spout element has internal threads, the cap element has external threads, and the cap element has a skirt which surrounds the spout. The skirt may have knurled gripping surfaces and a tamper-evidencing feature. The spout element and the cap element may be molded from thermoplastic materials of different hardnesses.

To provide for an easy and reliable initial rupture, the tear panel may have configured into it a reinforcing structure to increase its rigidity at the place where the initial rupture is to occur and to concentrate the rupturing forces there. To provide for gradual, controlled, and reliable propagations of the rupture, the initial distance between the bottom bearing surface of the cap element and the surface of the periphery of the tear panel directly below it should vary inversely as a function of distance from the hinge.

The stationary and rotatable closure elements may be attached to the end either before or after the end is seamed onto the can in a beverage filling line. Attaching them in a separate operation after seaming permits the use of conventional equipment in the filling line, as well as in the end manufacturing plant.

BEST MODES FOR CARRYING OUT THE INVENTION

Directional terms used in this application assume an orientation wherein the closure is secured to a can end which in turn is secured to a can standing upright, with a longitudinal axis extending vertically through their centers. This axis is the reference for "radius", "circumference", "inward", "outward", "upper", "lower", and cognate terms. Of course, the cans, ends, and other components may be otherwise oriented when they are manufactured, assembled, handled, shipped, sold, or used. The term "beverage" is used to mean any liquid food product, carbonated or non-carbonated, including beer, soft drinks, and juices. The term "lid" and can "end" will be used synonymously, with the former being preferred in the claims to avoid unintended locational connotations and the latter being preferred in the specification because it is standard industry terminology.

Figure 1:
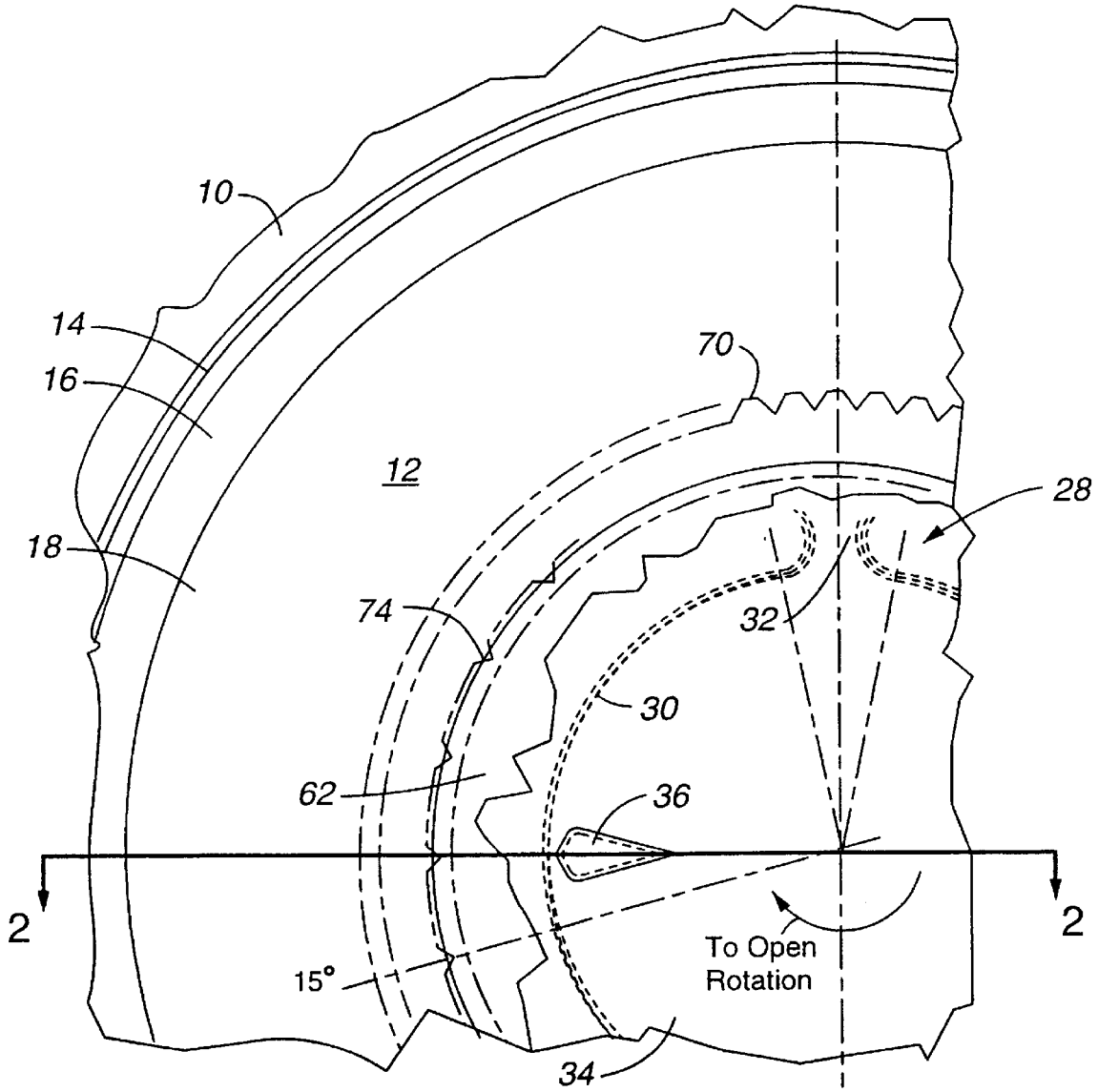
FIG. 1 is a partial, fragmentary plan view of an end and closure according to the invention, with the central portion of the closure broken away to expose the end.
Figure 2:
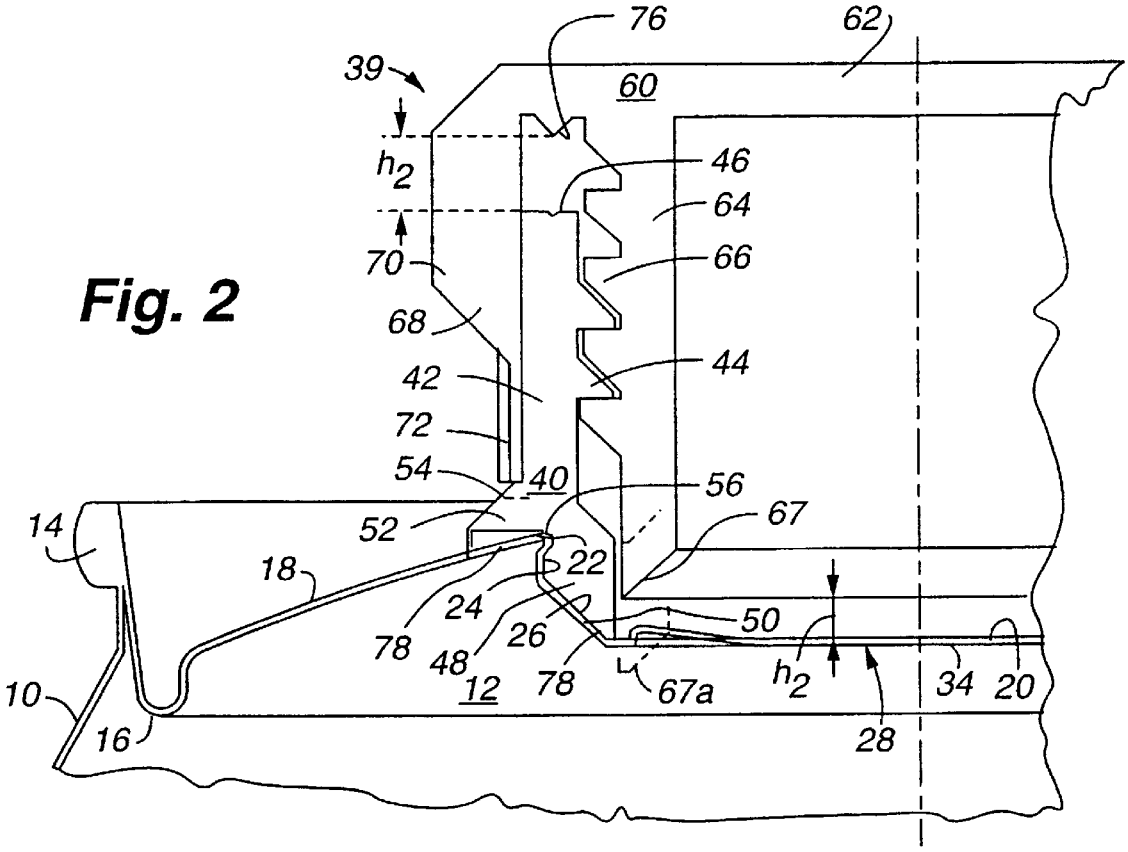
FIG. 2 is a view of a section taken at 2—2 in FIG. 1.

As shown in FIGS. 1 and 2, conventional can body 10 is attached and sealed to lid or end 12 by conventional double seam 14. End 12 has conventional countersink 16, domed panel 18, and concave recess or well 20. Well 20 is defined by lip 22, cylindrical wall 24, conical wall 26, and generally horizontal center panel 28. On center panel 28 are weakened line 30, hinge 32, tear panel 34, and upwardly projecting fracture or rupture beads 36. Weakened line 30 is preferably a score line, which may have a residual thickness which varies inversely with distance from hinge 32. The rupture bead 36 shown in FIG. 1 is one of five; the others are spaced counterclockwise around the periphery of the tear panel at 45° intervals. The height of each rupture bead is greater than the heights of all rupture beads closer to the hinge. As will be described below, the function of the rupture bead 36 shown in FIG. 1, which is opposite hinge 32, is to promote the initial rupture of score line 30 there, while the function of the remaining rupture beads is to propagate the rupture along the score line toward hinge 32.

Attached to end 12 is closure 39, which comprises two elements—stationary closure element or spout 40 and rotatable closure element or cap 60.

Spout 40 comprises cylindrical wall 42, boss 48, and flange 52. Cylindrical wall 42 has clockwise internal threads 44, upwardly facing circular reseal surface 46, and conventional external venting grooves (not shown) cut vertically in the threads. Boss 48, which has a conical portion 50, is separated from flange 52 by circular groove 56. Flange 52 has conical top surface 54.

Cap 60 comprises top wall 62, cylindrical inner wall 64, cylindrical outer wall 68, and downwardly facing circular reseal surface 76 between the walls. Inner wall 64 has clockwise external threads 66 and bottom bearing surface 67 including a horizontal portion and a conical portion. Outer wall 68 has annular knurled surface 70 and skirt 72 with vertical weakening grooves 74 spaced around it at 15° intervals.

Spout 40 is attached to end 12 by the locking of lip 22 in groove 56. The attachment may be effected by relative movement of boss 48 into well 20, with its conical portion 50 centering it, until lip 22 snaps into groove 56. In addition, end 12 and spout 40 may be bonded together by adhesive 78 on their mating surfaces. The bonding is effected, for example, by applying liquid or viscous adhesive to one or both of them before attachment, by heating or irradiating a solid heat-sensitive or UV-cured coating so applied, or by spin-welding by rotating spout 40 and end 12 with respect to each other under pressure, with a pre-applied solid heat-sensitive coating between them. Spout 40 reinforces and strengthens end 12. This is advantageous because it allows end 12 to be made of less metal, due to either a thickness reduction or due to a relatively gentle curvature of domed panel 18 (rather than a relatively tortuous profile for the purpose of increasing strength).

When provided to the consumer, can 10 is filled with beverage, and spout 40 and cap 60 are disposed as shown in FIG. 2. Bearing surface 67 is above tear panel 34 by a distance of $h_1$. Opposed reseal surfaces 46, 76 are spaced apart by a distance of $h_2$, which is greater than $h_1$.

To open the can and-access its contents, the consumer grips knurled surface 70 and rotates cap 60 in the clockwise direction, thereby moving cap 60 downward relative to spout 40 and tear panel 34. When cap 60 has moved a distance of approximately $h_1$, bearing surface 67 contacts the rupture bead 36 which is 180° from hinge 32, so as to concentrate the downward force of cap 60 on it and then to an adjacent point on score line 30, where shearing forces cause an initial rupture of score line 30. If can 10 contains pressure, the pressure is released to the interior of cap 60 and then passes through the venting grooves to the atmosphere. Simultaneously or just prior to the initial rupture, the bottom of skirt 72 is forced down against conical top surface of flange 52, which splays skirt 72 radially outward and fractures it at one or more grooves 74, so as to provide evidence of tampering. Continued rotation and downward movement of cap 60 cause bearing surface 67 to contact the next two rupture beads 36, which are 135° and 225° from hinge 32, and then to the 90° and 270° beads, thereby propagating the rupture of score line 30 toward hinge 32 in both directions from the 180° bead 36. Similarly, further rotation of cap 60 propagates the rupture to hinge 32 by exerting a shearing force on score line 30 and swings tear panel 34 about hinge 32 and downward into the can. Tear panel 34 will be in approximately a vertical attitude when continued rotation of cap 60 brings it to its downmost position.

At this point the consumer has the ability to unscrew and remove cap 60 by rotating it counterclockwise, and to pour the beverage into a glass or drink it directly from spout 40. As a practical matter, however, the consumer will continue clockwise rotation of cap 60 until surfaces 46, 76 come together, which stops the downward movement of cap 60 at downmost position 67*a*. At this point cap 60 has rotated a total of about 360° and moved downward a total distance of approximately $h_2$, and surfaces 46, 76 provide a pressure seal. The consumer will then unscrew cap 60 and pour or drink a portion of the beverage, after which he or she may replace the cap and rotate it clockwise again to reseal the container at surfaces 46, 76.

The position of threads 44, 66 (i.e., internal threads on the spout element and external threads on the rotatable element) is advantageous because threads 66 are relatively close to bearing surface 67, which prevents or minimizes flexing of the spout or cap from diminishing the shearing force on score line 30. This allows cylindrical walls 42, 64, and top wall 62 to be relatively thin. In contrast, see Meissner U.S. Pat. No. 3,339,812, which discloses a 2-piece closure having external threads on the stationary element and internal threads on the rotatable element. In addition, internal threads 44 on spout element 40 are not noticeable to the consumer during drinking from the can, and positioning threads 66 close to bearing surface 67 enables bearing surface 67 to be more precisely located with respect to score line 30.

Figure 3:
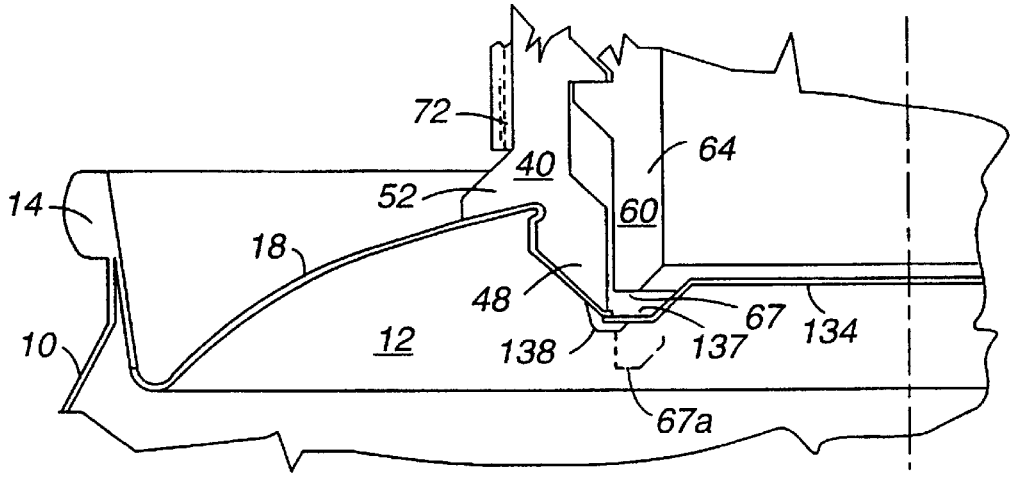
FIG. 3 is a view similar to FIG. 2, showing a variation of the invention in which the tear panel is formed by severing, coining, and a sealant, rather than by scoring.

FIG. 3 shows a variation in which the weakened line which defines tear panel 134 is not a score line, but rather a line created by an operation in which the tear panel is severed and coined or impacted at 137 so that the increase of its area enables it to extend under the remainder of center panel, and a sealant 138 (for example, a plastisol) seals the overlap and the exposed metal edge.

Figure 4:
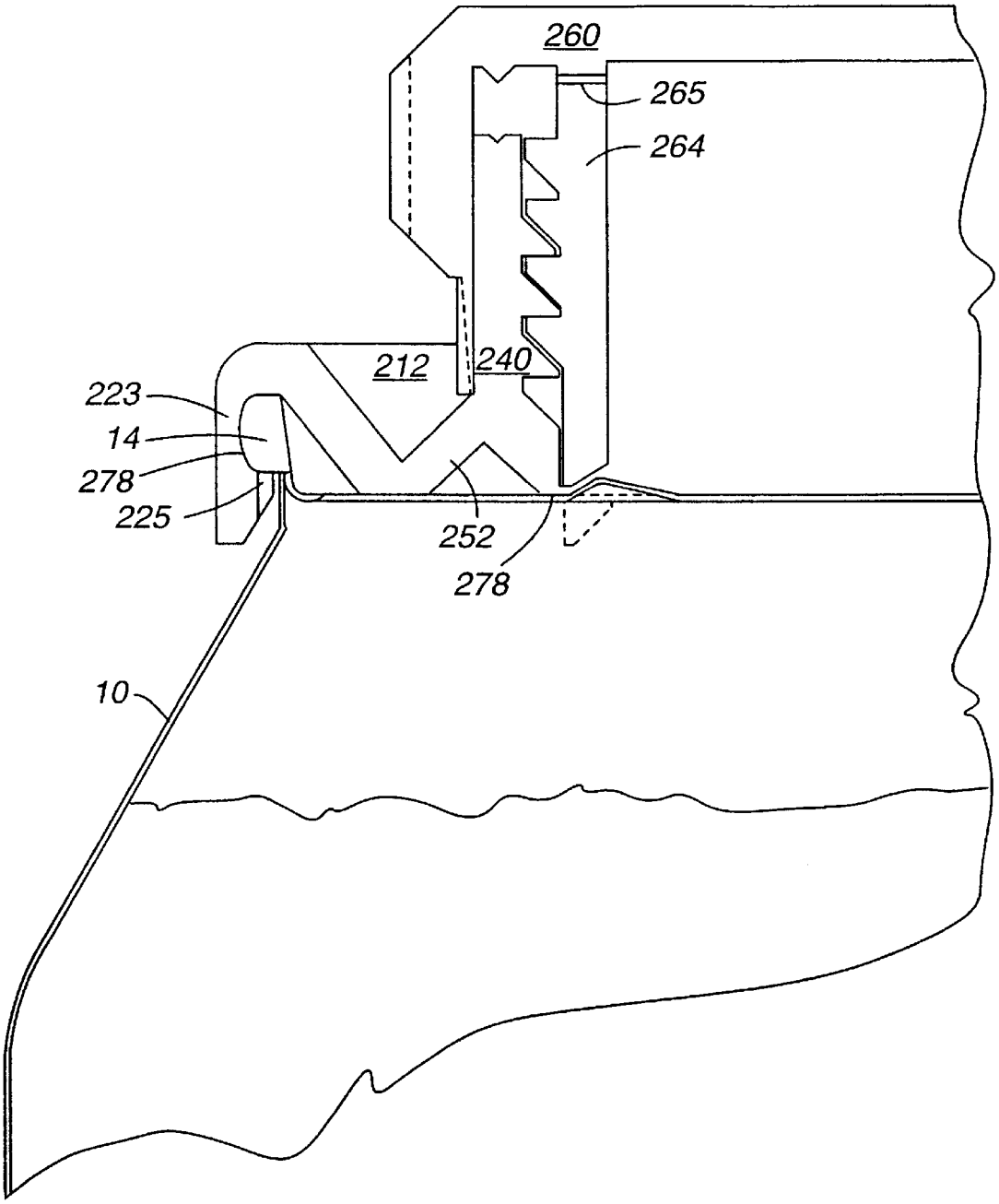
FIG. 4 is a view similar to FIG. 2, showing a variation of the invention in which the closure locks over the double seam.
Figure 5:
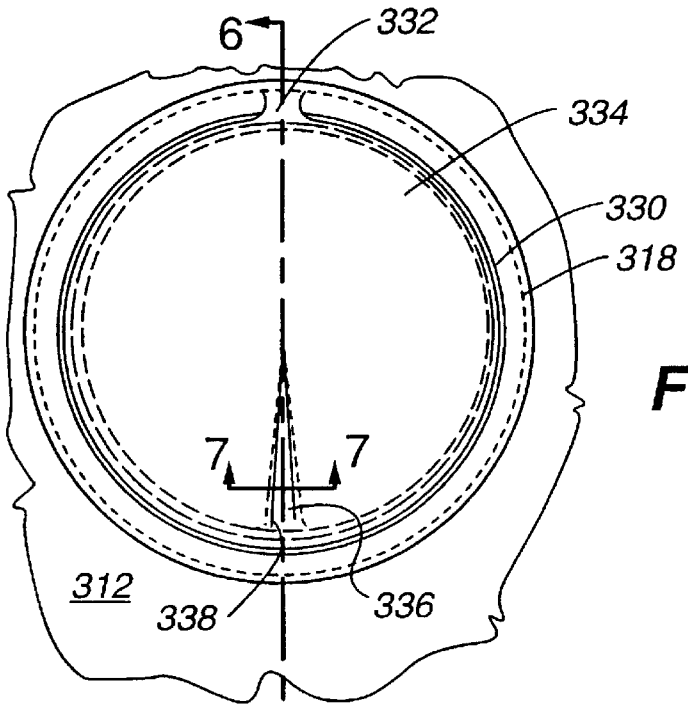
FIG. 5 is a fragmentary plan view of an end according to a variation of the invention in which the tear panel is continuously inclined.

In the variation shown in FIG. 4, end 212 is generally flat, without a dome or well, and has a smaller diameter than conventional ends, which are currently sizes 200 to 206 for beverages; I prefer size 109 or less. Flange 252 of stationary closure element or spout 240 is supported by end 212, extends radially outward beyond the edge of end 212, and terminates in skirt 223 with inturned annular bead 225 which locks under double seam 14. Spout 240 may be bonded to end 212 by adhesive 278. Venting holes 265 extend through inner wall 264 of cap 260.

Figure 6:
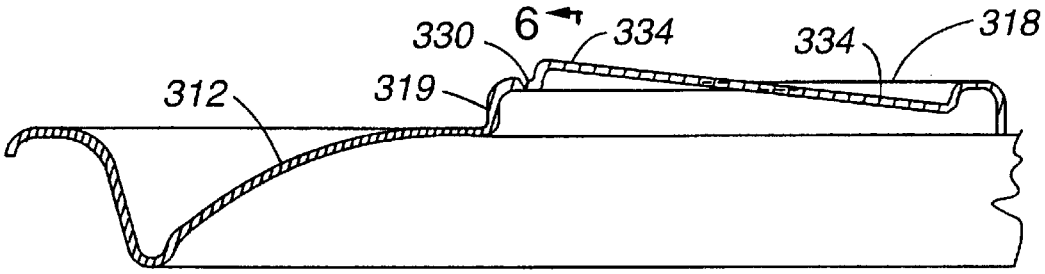
FIG. 6 is an extended view of a section taken at 6—6 in FIG. 5.
Figure 7:
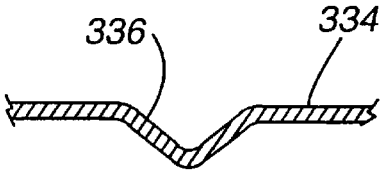
FIG. 7 is a view of a section taken at 7—7 in FIG. 5.

FIGS. 5–8 show end 312 with raised panel 318 having side wall 319. Score line 330 defines hinge 332 and tear panel 334, which is continuously inclined from a maximum height near its left hand edge to a maximum depth near its right hand edge, as shown in FIG. 6. The spout and the cap are not shown. The spout, which is similar to spout 240 shown in FIG. 4 except for the shape of its base, is also bonded to the end by an adhesive. The cap is similar to cap 260 shown in FIG. 4.

Downwardly projecting strengthening bead 336 extends between the center of tear panel 334 and point 338 on score line 330, terminating as close as possible to point 338. The bottom of reverse bead 336 is a horizontal straight line which intersects score line 330. The purpose of reverse bead 336 is to promote initial rupture by concentrating maximum force at a single place on score line 330 (point 338) and increasing in that vicinity the resistance of tear panel 334 to deformation under the downward force exerted by the cap's bottom bearing surface 67 on the two high surfaces straddling bead 336.

Figure 8:
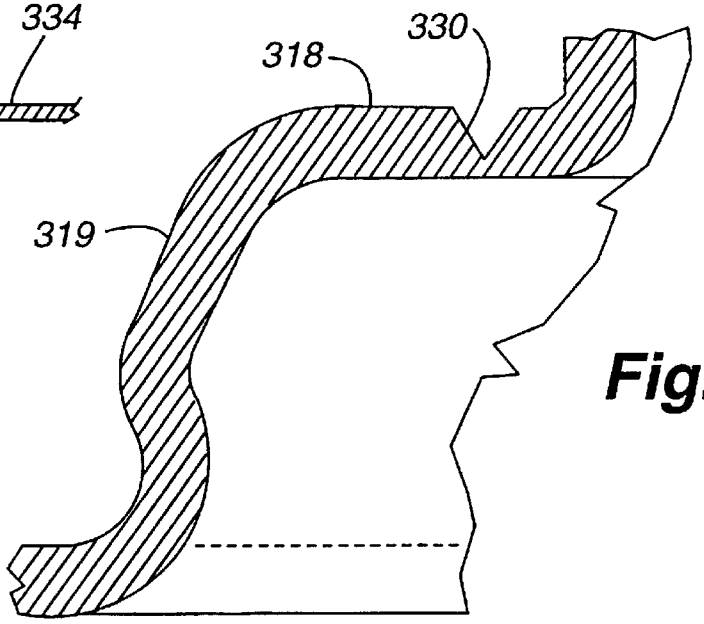
FIG. 8 is an enlarged view of a portion of FIG. 6.

The score line residual thickness (for example 340 as depicted in FIG. 8) may be less at the point of initial rupture than at other locations on the score line, in order to promote the initial rupture. The presently preferred score line residual depths are 0.003 inch at point 338 and to 15° in both circumferential directions therefrom, and 0.004 inch elsewhere. The score line shown in FIG. 8 has a conventional cross-sectional configuration, but the configuration may be modified to decrease the distance of its centerline from wall 319.

Figure 9:
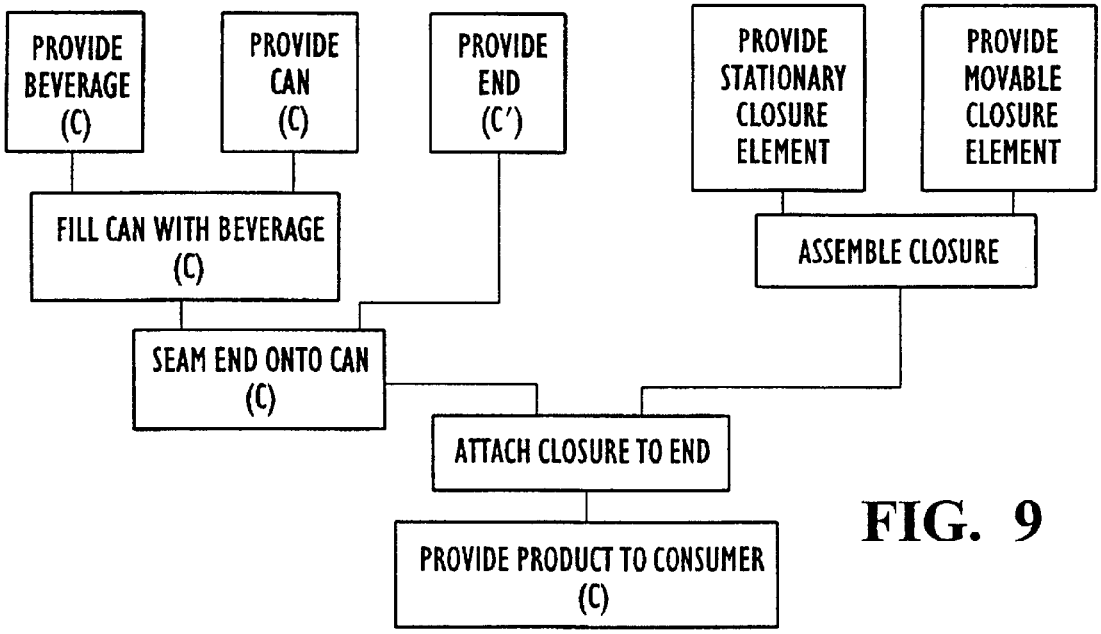
FIG. 9 shows a process for producing a consumer product from its component elements.

FIG. 9 shows the preferred process for producing, from the components described above and the beverage or other product to be contained by them, the packaged product for the consumer. A parenthetical "C" designates conventional operations, and a parenthetical "C'" designates operations which are essentially conventional with tooling and/or other minor equipment modifications. Because of the high speeds of current can and end manufacturing operations and beverage filling and seaming operations, and of the capital investments these operations require, it is highly desirable to use conventional operations as much as possible. By attaching the closure to the end at a separate station subsequent to filling and seaming, the present invention permits the use of conventional beverage filling and seaming operations, using standard equipment. Moreover, the end, though not completely conventional, is sufficiently close to a conventional end that it may be formed and handled in a conventional can end manufacturing plant, using mostly conventional equipment.

Figure 10:
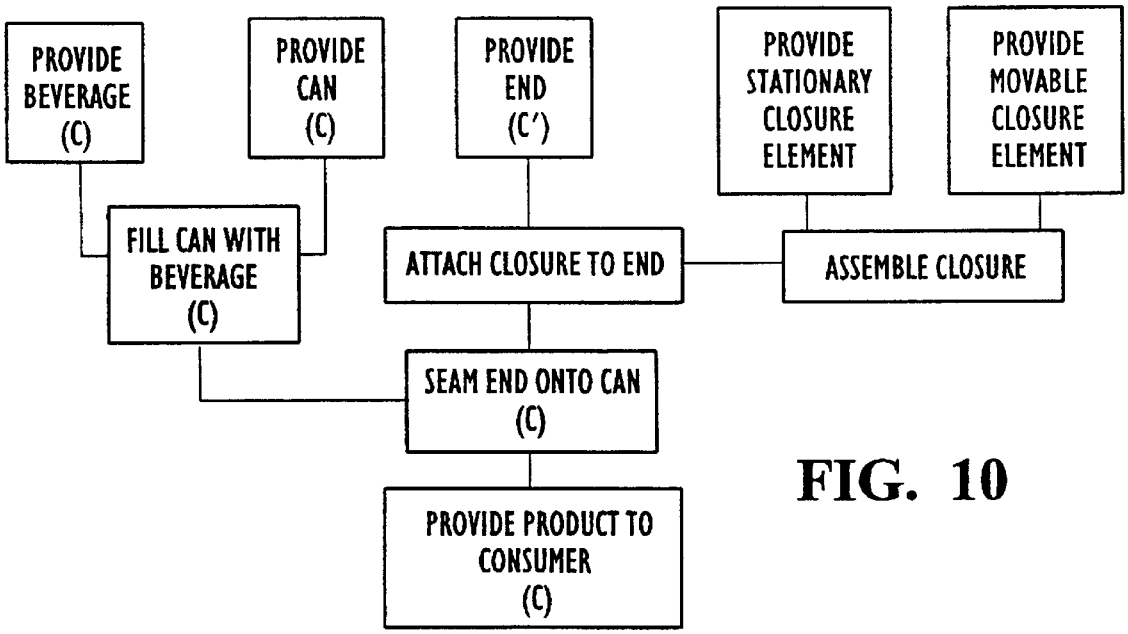
FIG. 10 shows a variation of the process shown in FIG. 9.

FIG. 10 is similar to FIG. 9, but shows an alternative process in which the closure is attached to the end before the end is seamed on the can. This process avoids the need for a separate attaching station subsequent to seaming, but requires a modified, and probably slower, seaming operation, and of course requires the closure to be attached to the end farther upstream. This alternative might be acceptable for an existing small scale, relatively slow filling and seaming operation.

FIGS. 1–8 are drawn to scale, for a size 202 can and end, except for sheet metal thicknesses. Typical dimensions in inches for the embodiment shown in FIGS. 1 and 2 are as follows:

O.D. of double seam 14—2.125
O.D. of cap outer wall 68—1.225
I.D. of cap outer wall 68—1.010
O.D. of spout wall 42—1.000
I.D. of end cylindrical wall 24—0.950
I.D. of spout wall 42, not including threads—0.862
O.D. of cap inner wall 64, including threads—0.852
I.D. of spout wall 42 at boss 48—0.762
O.D. of cap inner wall 64, not including threads—0.752
Diameter of score line 30 (center to center)—0.752
I.D. of cap inner wall 64—0.625
Height of spout 40—0.868
Height of cap 60—0.793
Height of end 12—0.288
$h_1$—0.075
$h_2$—0.110
Height of highest rupture bead 36—0.020
Thickness of cap top wall 62—0.081

Spout 40 and cap 60 should be made from a relatively hard plastic with good point strength and impact strength, such as a polycarbonate. Preferably spout 40 is softer than cap 60, since spout 40 needs to be easy to install and to seal tightly with end 12, while cap 60 needs to fracture at grooves 74 and easily rupture score line 30.

Rupture beads 36 may be varied in number and/or angular distribution about tear panel 34, and may be replaced wholly or partly by a continuous bead or a continuously inclined tear panel, which may be on either a depressed panel or a raised panel similar to the panel shown in FIG. 3. As an alternative, it is possible to vary the depth of bearing surface 67 (for example, by making the plane of bearing surface 67 non-perpendicular to the axis of the can), but this is not preferred, since it would require a specific rotational orientation of closure 39 with respect to end 12 during assembly.

Threads 44, 66 are preferably buttress threads with a horizontal top surface so as to maximize the ability of cap 60 to exert a downward force on the tear panel. The presently preferred thread pitch (the ratio of height to circumference) is about 0.08 to 0.09, which yields a good compromise between the mechanical advantage for opening the tear panel and the number of revolutions required to remove the rotatable element.

It will be understood that, while presently preferred embodiments of the invention have been illustrated and described, the invention is not limited thereto, but may be otherwise variously embodied within the scope of the following claims.

I claim:

1. An assembly for (i) closing and sealing a thin-walled metal can body containing a beverage, (ii) easily and quickly providing a passage suitable for pouring and drinking the beverage, and (iii) conveniently reclosing and resealing the can, which assembly comprises a sheet metal lid having (A) a periphery shaped for fastening to a rim surrounding the open end of the can body, and (B) a curved, rupturable, weakened line which (a) defines most of the periphery of a non-removable tear panel while leaving between the tear panel and the remainder of the lid an integral hinge, and (b) extends away from one end of the hinge, around a bight where it is distant from the hinge, and back to the other end of the hinge;

a stationary closure element mounted on the lid so as to enclose the tear panel, which stationary closure element has an upwardly facing annular reseal surface and helical threads surrounding an axial pouring passage;

a rotatable closure element having a downwardly facing annular reseal surface, helical threads, and a bottom bearing surface;

the threads of the stationary element and rotatable element engaging so that rotation of the rotatable element in one direction drives the rotatable element downward toward the lid and rotation of the rotatable element in the opposite direction, if continued, results in disengagement of the threads and allows removal of the rotatable element from the stationary element;

the bottom bearing surface of the stationary element being aligned with the periphery of the tear panel, whereby rotation of the rotatable element in said first direction, if continued, initially ruptures the weakened line at a predetermined place distant from the hinge, propagates the rupture in two directions toward the hinge, and eventually causes the tear panel to pivot downward about the hinge.

2. The assembly according to claim 1 wherein initially, before the rotatable element is rotated, the respective reseal surfaces are so spaced from each other that rotation of the rotatable element in said one direction, beyond the position required to cause the tear panel to pivot downward, causes the reseal surfaces to engage and form a pressure seal.

3. The assembly according to claim 1 wherein the threads of the stationary element are internal threads and the threads of the rotatable element are external threads near its bearing surface.

4. The assembly according to claim 1 wherein the internal threads are located on a cylindrical wall of the stationary element and the external threads are located on a cylindrical wall of the rotatable element.

5. The assembly according to claim 4 wherein the rotatable element has a top wall and a cylindrical skirt extending downward therefrom, so that the cylindrical wall of the stationary element is disposed between, and is concentric with, the cylindrical wall and the skirt of the rotatable element.

6. The assembly according to claim 5 wherein at least an annular portion of the outer surface of the skirt is knurled.

7. The assembly according to claim 5 wherein the stationary element has a flange extending outward and below the bottom of the skirt of the rotatable element, so that as the rotatable element is rotated in said first direction, but before the weakened line of the lid is ruptured, the bottom of the skirt deforms to provide permanent evidence of the rotation.

8. The assembly according to claim 5 wherein vertical weakening grooves are spaced around the bottom of the skirt.

9. The assembly according to claim 1 wherein the stationary element and the rotatable element are each made of a different plastic material, the material of the stationary element being softer than the material of the rotatable element, whereby the stationary element is easy to install and seals tightly with the lid, and the rotatable element has good point strength and impact strength for initially rupturing the weakened line and propagating the rupture.

10. The assembly according to claim 1 wherein the weakened line is a score line.

11. The assembly according to claim 10 wherein the score line residual thickness is less at said predetermined place of initial rupture than it is at locations elsewhere on the score line.

12. The assembly according to claim 1 wherein the vertical distance between said bottom bearing surface and the periphery of the tear panel directly beneath it is a minimum at said predetermined place of initial rupture and varies as an inverse function of distance from the hinge, so that rotation of the rotatable element causes concentrated shearing forces to be applied at the points of incipient rupture as the rupture propagates gradually and controllably around the weakened line in two directions toward the hinge.

13. The assembly according to claim 12 wherein said predetermined place of initial rupture is opposite the hinge.

14. The assembly according to claim 12 wherein the variation in said vertical distance is determined by the configuration of the surface of the periphery of the tear panel.

15. The assembly according to claim 12 wherein said tear panel periphery includes discrete beads.

16. The assembly according to claim 12 wherein said tear panel periphery includes a continuously inclined surface.

17. The assembly according to claim 12 wherein a reinforcing structure in the tear panel adjacent said predetermined place of initial rupture provides rigidity to the tear panel and concentrates, at said place, forces for causing initial rupture of the weakened line.

18. The assembly according to claim 12 wherein approximately one revolution of the rotatable element causes initial rupture of the weakened line and propagation of the rupture to the hinge.

19. The assembly according to claim 1 wherein the exterior configuration and dimensions of the lid are similar to those of stay-on-tab lids which are standard in the beverage industry, so that the lid, without the stationary element mounted on it, may be fastened to a can in a beverage filling line using conventional equipment.

20. A method of canning a beverage in a beverage filling line, in a can with an assembly according to claim 1, which method comprises:

providing the lid;

providing the stationary closure element;

providing a can body having a rim surrounding its open end;

filling the can with a beverage;

fastening the periphery of the lid to the rim of the can;

mounting the stationary closure element on the lid so that the axial pouring passage is aligned with the tear panel.

* * * * *